United States Patent [19]

Turgeon

[11] Patent Number: 4,479,312

[45] Date of Patent: Oct. 30, 1984

[54] FOLDABLE SNOW COMPACTOR WITH SIDE WINGS PIVOTABLE BEHIND CENTRAL BLADE

[75] Inventor: Harry S. Turgeon, Lewiston, Me.

[73] Assignee: Valley Engineering, Inc., Gray, Me.

[21] Appl. No.: 481,763

[22] Filed: Apr. 11, 1983

[51] Int. Cl.[3] ..... E01C 19/22; E02F 3/76

[52] U.S. Cl. ..... 37/219; 37/268; 37/281; 172/815

[58] Field of Search ..... 37/225, 274, 219, 268, 37/281; 172/815, 823, 822

[56] References Cited

U.S. PATENT DOCUMENTS

| | | | |
|---|---|---|---|
| 2,938,285 | 5/1960 | Lindeman | 172/823 X |
| 3,424,251 | 1/1969 | Bouley | 172/815 |
| 3,429,380 | 2/1969 | Launder et al. | 172/815 |
| 3,477,151 | 11/1969 | Zanella | 172/815 |
| 3,657,828 | 4/1972 | Anderson | 37/274 |
| 4,019,268 | 4/1977 | Waterman | 37/219 |
| 4,356,645 | 11/1982 | Hine et al. | 37/281 |

FOREIGN PATENT DOCUMENTS

| | | | |
|---|---|---|---|
| 265395 | 11/1926 | Canada | 172/823 |
| 268019 | 2/1927 | Canada | 172/823 |

*Primary Examiner*—E. H. Eickholt

*Attorney, Agent, or Firm*—Thompson, Birch, Gauthier and Samuels

[57] ABSTRACT

A foldable snow compactor has a center pan with a pair of operatively positioned wings extending from the ends thereof. The wings are mounted for pivotal movement about axes fixed in relation to the center pan. Single hydraulic piston-cylinder units are employed to pivot the wings through arcs of approximately 180° between their operative extended positions and inoperative positions located rearwardly of the center pan and substantially entirely within the width dimension thereof.

9 Claims, 6 Drawing Figures

FOLDABLE SNOW COMPACTOR WITH SIDE WINGS PIVOTABLE BEHIND CENTRAL BLADE

BACKGROUND OF THE INVENTION

1. Field of the Invention

This invention relates generally to equipment used for grooming ski trails and the like, and is concerned in particular with an improved foldable snow compactor of the type which is adapted to be towed behind a vehicle.

2. Description of the Prior Art

There now exists a number of conventional snow compactor made up of center pans with pivotal wings extending operatively from the ends thereof. In some of these compactors, the wings are not foldable to inoperative positions located behind and entirely within the width of the center pan. This sometimes presents problems for the operator when using the compactor in wooded areas or on narrow trails. Other conventional compactors do provide for a complete folding of the wings behind and within the width of the center pan, but these employ unduly complex and expensive mechanisms, with multiple hydraulic piston cylinder units for each wing. Moreover, the conventional compactors often deal with the problem of overloading the wings by interposing shear pins or the like in the adjustment mechanisms. When such pins are sheared, they must be replaced by operating or maintenance personnel before use of the compactor can be resumed.

SUMMARY OF THE PRESENT INVENTION

A primary objective of the present invention is to provide an improved foldable snow compactor wherein the wings are each pivotable about a fixed axis by means of a single hydraulic piston cylinder unit, with the movement of the wings being through arcs of approximately 180° (perhaps slightly greater in some cases) between their extended operative positions, and inoperative positions located behind and substantially entirely within the width dimension of the center pan.

A further objective of the present invention is to provide an improved means for hydraulically compensating for overloading of the wings, thereby avoiding the use of shear pins or the like.

These and other objects and advantages of the present invention will become more apparent as the description proceeds with the aid of the accompanying drawings, wherein:

DETAILED DESCRIPTION OF PREFERRED EMBODIMENT

Figure 1:
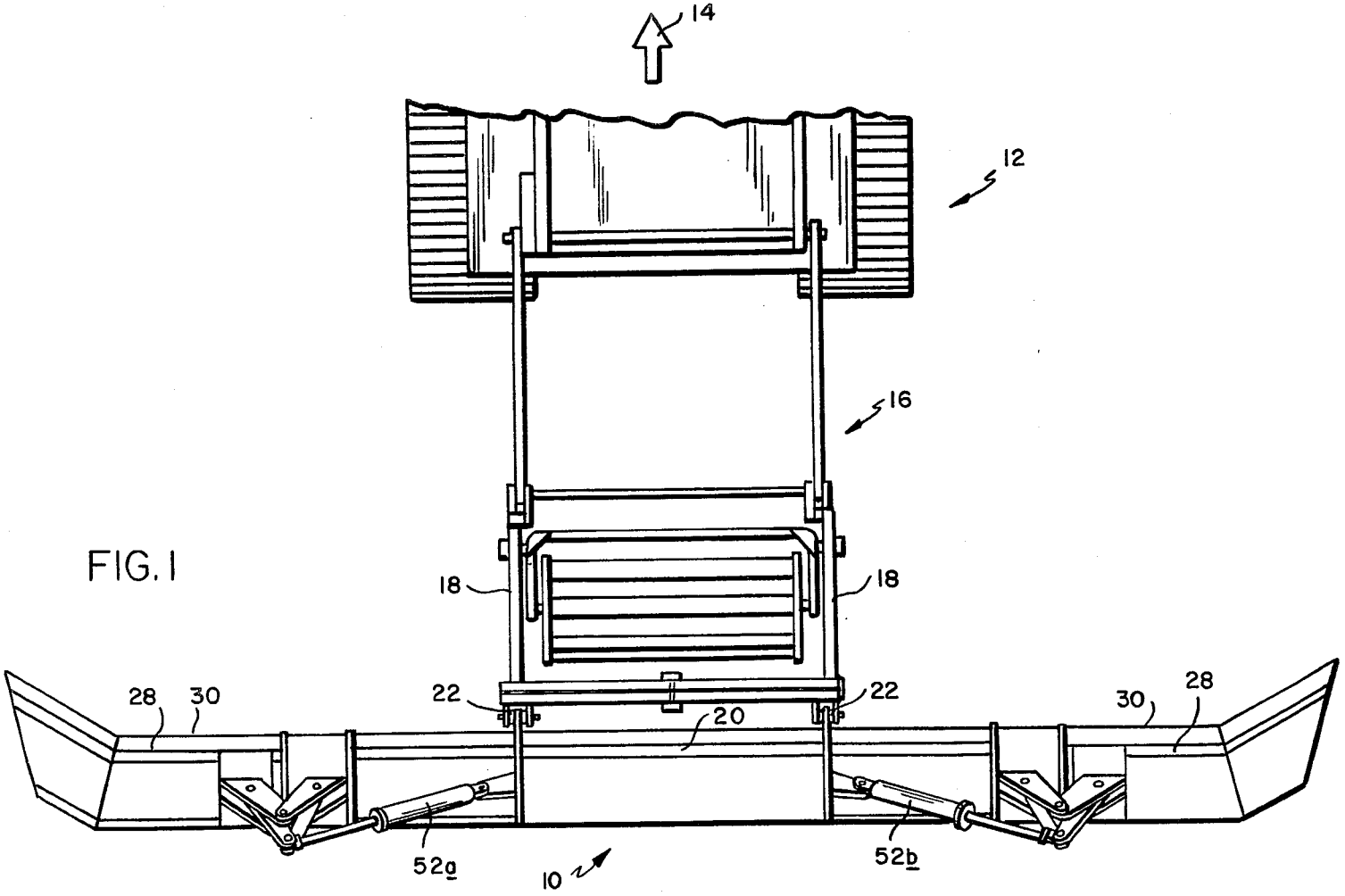
FIG. 1 is a plan view of a foldable snow compactor in accordance with the present invention, with the wings in their operative extended positions.

Referring initially to FIG. 1, a compactor in accordance with the present invention is shown at 10 being towed by a tracked vehicle 12 moving along a path indicated schematically by arrow 14. The compactor is connected to the vehicle by a towing hitch 16 which includes rearwardly extending members 18 pivotally connected to the center pan 20 of the compactor as at 22.

Referring additionally to FIGS. 2 to 5, it will be seen that the center pan 20 is elongated and extends transversally across the path 14 of vehicle travel. The center pan has a forwardly facing generally convex front surface 25, a lower serrated working edge 24, and laterally outwardly facing end surfaces 26. While the center pan 10 is illustrated as a unitary piece, it will be understood that as herein employed, the term "center pan" is intended also to include other conventional center pan assemblies, including those for example where two pan sections are centrally interconnected for pivotal adjustment to various configurations in addition to straight across lateral alignment.

Figure 2:
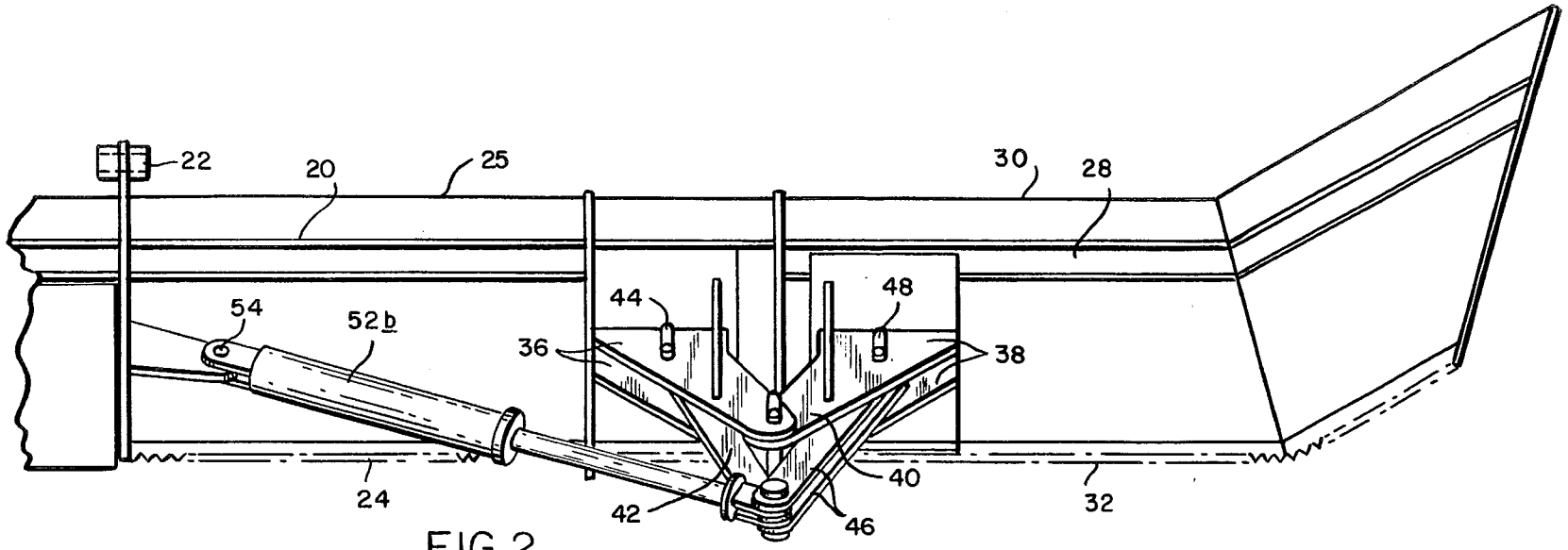
FIG. 2 is an enlarged plan view of one end of the compactor shown in FIG. 1.
Figure 3:
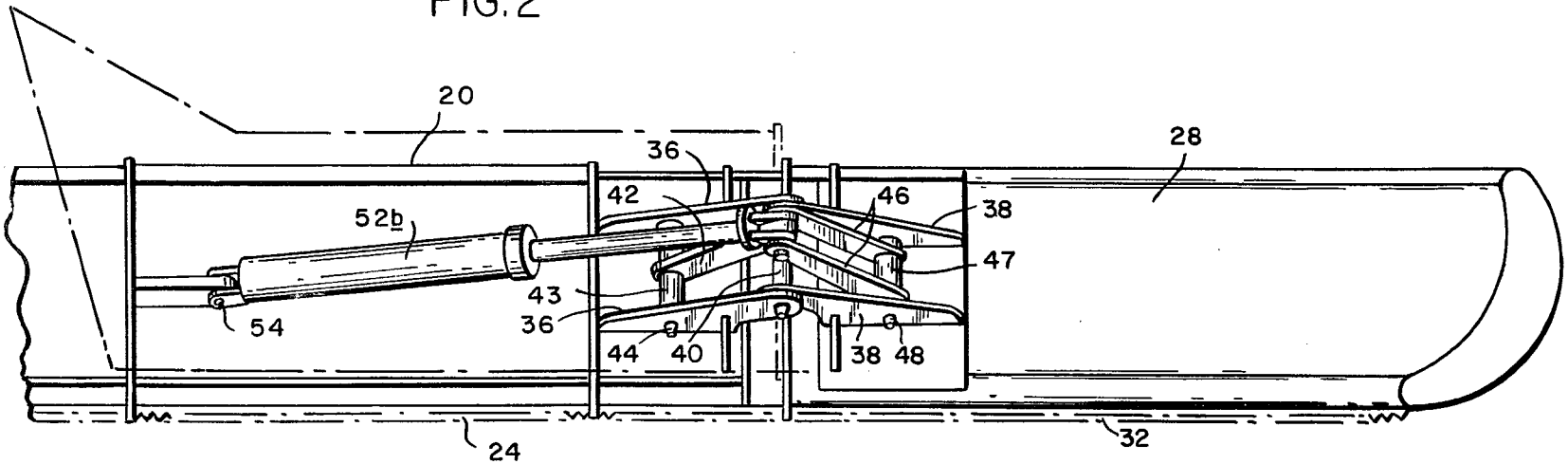
FIG. 3 is a rear elevational view of the components shown in FIG. 2.

A pair of wings 28 are located at the ends of the center pan 20. Each wing 28 has a forwardly facing generally convex front surface 30, a lower serrated working edge 32, and an inwardly facing end surface 34. When operatively positioned as shown in FIGS. 1–3, the front surfaces 30 and lower working edges 32 of the wing blades provide continuing lateral extensions of the front surface 25 and lower working edge 24 of the center pan 20, with the laterally inwardly facing end surfaces 34 of the wings being in contact with the laterally outwardly facing end surfaces 26 of the center pan along parallel planes indicated schematically in FIG. 5 at "P". Although not illustrated, it will be understood that other wing designs may be employed, including those whose complete front surfaces are angularly disposed with respect to the first surface of the center pan when the wings are operatively extended.

Figure 4:
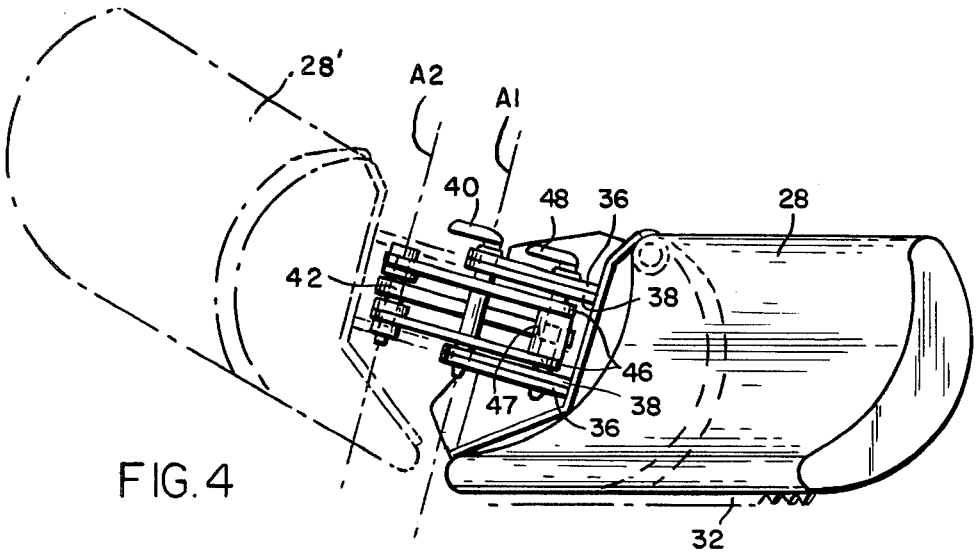
FIG. 4 is an end view of the compactor.

Each wing 28 is joined to an end of the center pan 20 for pivotal movement about an axis "$A_1$", which as can best be seen in FIG. 4, is inclined forwardly from the vertical. As is best shown in FIGS. 2–4, this pivotal connection is provided by first arms 36 fixed to and extending rearwardly from the center pan 20, and second arms 38 which are fixed to and extend rearwardly from the wings 28. The arms 36 and 38 are pivotally interconnected at the axes $A_1$ by removable pins 40. As can best be seen in FIG. 5, the axes $A_1$ are located in the planes P rearwardly of the front surface 25 of the center pan 20.

Figure 5:
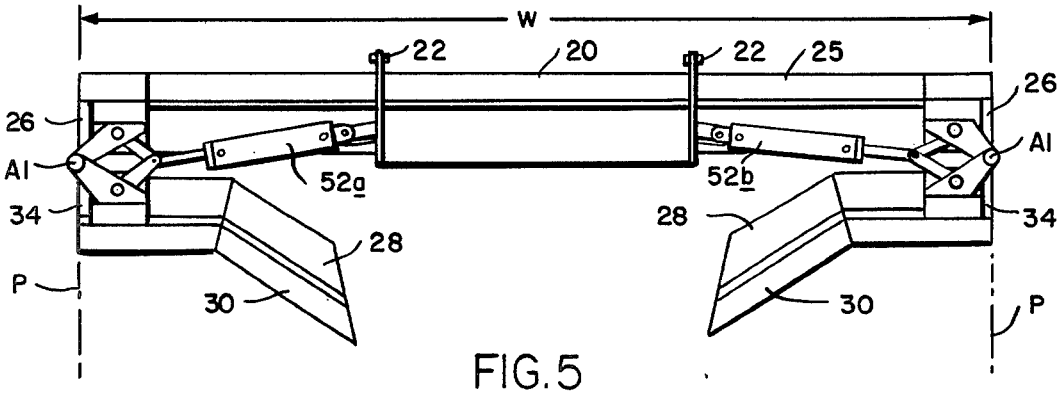
FIG. 5 is a plan view on a reduced scale showing the wings adjusted to their inoperative positions behind the center pan.

Operating means are employed to pivot the wings 28 about their respective axes $A_1$ through arcs of approximately 180° from the operative positions shown in FIGS. 1–4 to the inoperative positions shown in FIG. 5. As shown by the dot-dash lines at 28' in FIG. 4, because the axes $A_1$ are inclined forwardly, the wings are gradually raised as they are pivoted to their inoperative positions.

The operating means includes single leaf first links 42 having integral sleeves 43 pivotally connected to the first arms 36 by pins 44, and double leaf second links 46 having integral sleeves 47 pivotally connected to the second arms 38 by pins 48. The first and second links 42, 46 are pivotally interconnected at 50 along second axes $A_2$ located rearwardly of the axes $A_1$.

A pair of hydraulic double acting piston-cylinder units 52*a*, 52*b* is provided, one for each wing 28. The piston-cylinder units are connected to the first and second links 42, 46 at their point of pivotal interconnection along axes $A_2$, and to the center pan 20 as at 54. Extension and retraction of the piston-cylinder units acting through the first and second links 42, 44 and the first and second arms 36, 38 will result in the wings being pivotally manipulated through arcs of approximately 180° between their operative and inoperative positions. As can be best seen in FIG. 5, when the wings are in their inoperative positions, they are located behind and substantially entirely within the width "W" of the center pan 20 as measured from one to the other of the center pan's laterally outwardly facing end surfaces 26.

Figure 6:
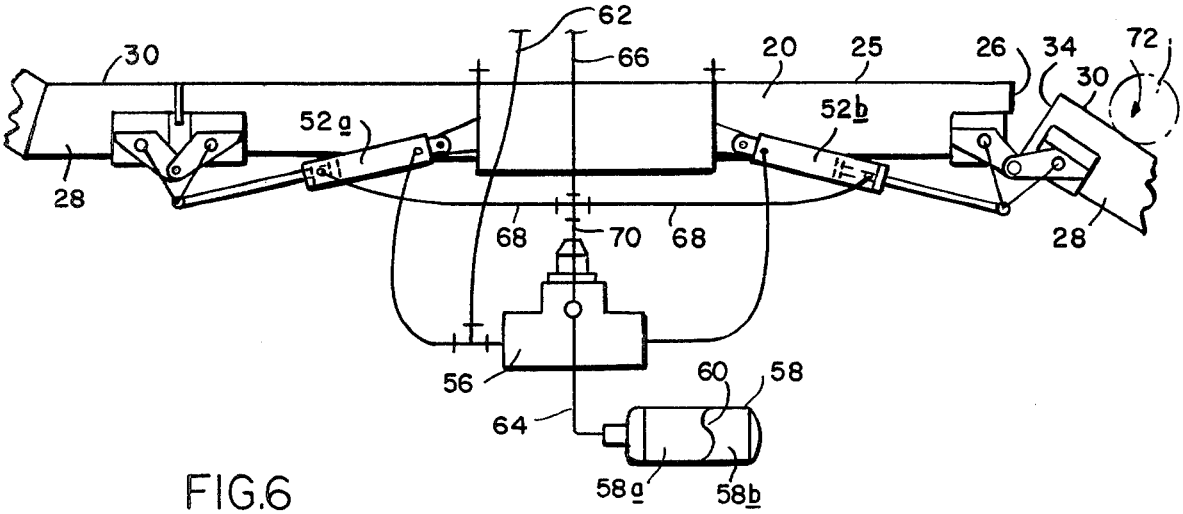
FIG. 6 is a circuit diagram illustrating the hydraulic means for compensating for over-loading of the wing blades.

Referring now to FIG. 6, the hydraulic overload means of the present invention is schematically depicted as including a pressure relief valve 56 and an accumulator 58, the latter being internally subdivided by a flexible diaphragm 60 into a fluid receiving chamber 58*a* and a chamber 58*b* containing a pressurized gas. The accumulator 58 is a commercially available component, for example Model No. 0531012600 sold by Robert Bosch G.M.B.H. of Stuttgart, Federal Republic of Germany.

A high pressure hydraulic fluid in conduit 62 leads from an operator's control valve (not shown) on the vehicle 12. Conduit 62 is connected via a T connection to the high pressure side of piston-cylinder unit 52*a*, as well as to the high pressure side of piston-cylinder unit 52*b* via pressure relief valve 56. The pressure relief valve also is connected by conduit 64 to the accumulator chamber 58*a*.

A low pressure hydraulic fluid conduit 66 leads from the previously mentioned operator's control valve and is connected via branch conduits 68 to the low pressure sides of the piston-cylinder units 52*a*, 52*b*, as well as by another branch conduit 70 to the pressure relief valve.

When the compactor is being advanced with both wings operatively positioned, the piston-cylinder units 52*a*, 52*b* are fully extended and any flow of hydraulic fluid through either conduits 62 or 66 is blocked by the operator's control valve. Therefore, should one of the wings encounter an obstruction such as for example a tree stump 72 as shown in FIG. 6, that wing will be forced back, causing a momentary surge of hydraulic fluid pressure in the network of high pressure conduits. When this occurs, the pressure relief valve will automatically react by bleeding hydraulic fluid via conduit 64 to the accumulator chamber 58*a*, with the diaphragm 60 reacting to further pressurize the gas in chamber 58*b*. As soon as the obstacle has been cleared, the operator can reset the wing by admitting more high pressure hydraulic fluid into the system via conduit 62. The fluid admitted into accumulator chamber 58*a* will eventually bleed back into the system, either during resetting of the wing, or when the wings are retracted to their inoperative positions. If the bleed-back of fluid from the accumulator 58 results in an excessively rapid and abrupt resetting of the wings, a throttle valve 74 may be interposed in line 64. Also, under certain circumstances, depending on the hydraulic arrangement of the vehicle 12, it may be possible to eliminate the accumulator 58, and instead simply direct the return line 64 back to the vehicle hydraulic reservoir R, as shown by the dot-dash connection 64'.

In light of the foregoing, it now will be appreciated by those skilled in the art that the present invention offers a unique combination of highly advantgeous features. Among these are: the ability to adjust the wings between their operative fully extended positions and retracted inoperative positions behind and substantially entirely within the width dimension of the center pan; the achievement of the aforesaid adjustments by means of a relatively simple mechanism employing single rather than multiple piston cylinder units for each wing; and, the incorporation of means for automatically compensating for overpressurization of the hydraulic system in the event that one or both of the wings are forced back as a result of their encountering a fixed obstacle.

I claim:

1. A foldable snow compactor of the type adapted to be towed behind a vehicle, said compactor comprising:

a center pan having a forwardly facing front surface, a lower working edge, and laterally outwardly facing end surfaces;

a pair of wings, each having a forwardly facing front surface, a lower working edge, and a laterally inwardly facing end surface, said wings being adapted to be operatively positioned at opposite ends of said center pan, with their front surfaces and working edges providing continuing extensions of the front surface and working edge of said center pan, and with the end surfaces of said wings being in contact with respective ones of the end surfaces of said center pan;

connecting means for joining said wings to said center pan for pivotal movement about axes located rearwardly of the front surfaces of said center pan and wings;

and operating means associated with said connecting means for pivoting said wings between said operative positions and inoperative positions located rearwardly of said center pan.

2. The compactor of claim 1 wherein said axes are inclined forwardly from the vertical, and wherein said wings are raised while being pivoted about said axes from said operative positions to said inoperative positions.

3. The compactor of either claims 1 or 2 wherein said connecting means comprises first arms fixed to and extending rearwardly from said center pan, and second arms fixed to and extending rearwardly from said wings, said first and second arms being pivotally interconnected at said axes.

4. The compactor of claim 3, wherein said operating means includes first links pivotally connected to said first arms, second links pivotally connected to said second arms, said first and second links being pivotally interconnected at second axes located rearwardly of said first-mentioned axes, and a pair of piston-cylinder units each of which is pivotally connected at one end to said interconnected first and second links at said second axis and at the opposite end to said center pan.

5. The compactor of claim 4 wherein extension and retraction of said piston-cylinder units imparts pivotal movement to said wings between said operative and inoperative positions through arcs of approximately 180°.

6. The compactor of claim 4, wherein said piston-cylinder units are of the double acting hydraulic type, each unit being extended by high pressure hydraulic fluid received via a network of high pressure fluid conduits, and each unit being retracted by low pressure hydraulic fluid received via a network of low pressure fluid conduits, said high pressure network of fluid conduits being connected via a pressure relief valve to an accumulator means for receiving and temporarily storing hydraulic fluid to relieve said high pressure network of fluid conduits from overpressurization in the event that one or both of said wings should strike an obstacle and be forcibly pivoted to the rear.

7. The compactor of either claims 1 or 2 wherein said axes are arranged in coplanar relationship with the end surfaces of said center pan.

8. The compactor of either claims 1 or 2 wherein said inoperatively positioned wings are located substantially entirely inwardly of the width of said center pan as measured from one to the other of said laterally outwardly facing end surfaces.

9. A foldable snow compactor of the type adapted to be towed behind a vehicle, said compactor comprising:

a center pan having a lower working edge, a forwardly facing front surface and laterally outwardly facing end surfaces defining the overall width of said center pan;

a pair of wings, each having a lower working edge, a forwardly facing front surface and a laterally inwardly facing end surface, said wings being adapted to be operatively positioned at opposite ends of said center pan, with their front surfaces and working edges providing continuing extensions of the front surface and working edge of said center pan, and with the end surfaces of said wings being in contact with respective ones of the end surfaces of said center pan;

connecting means for joining said wings to said center pan for pivotal movement about first axes inclined forwardly from the vertical and located rearwardly of the front surfaces of said center pan and wings, said connecting means including first arms fixed to and extending rearwardly from said center pan, and second arms extending rearwardly from said wings and being pivotally connected to said first arms at said first axes;

operating means associated with said connecting means for pivoting said wings between said operative positions and inoperative positions located rearwardly of said center pan and substantially entirely within said width dimension, said operating means including first links pivotally connected to said first arms, second links pivotally connected to said second arms, said first and second arms being pivotally interconnected at second axes located rearwardly of said first axes, with a pair of hydraulically actuated piston-cylinder units each of which is pivotally connected at one end to said first and second links at said second axis and at the opposite end to said center pan, said piston-cylinder units being extended by the application thereto of high pressure hydraulic fluid via fluid conduits in order to operatively position said wings; and relief means communicating with said fluid conduits for receiving and temporarily storing hydraulic fluid to prevent overpressurization of said fluid conduits in the event that fluid is expelled from said piston-cylinder units as a result of said operatively positioned wings being forced rearwardly against the holding action of said piston-cylinder units.

* * * * *